United States Patent [19]

Choinski

[11] 4,283,443

[45] Aug. 11, 1981

[54] METHOD AND APPARATUS FOR COATING WEBS

[75] Inventor: Edward J. Choinski, Wayland, Mass.

[73] Assignee: Polaroid Corporation, Cambridge, Mass.

[21] Appl. No.: 762,950

[22] Filed: Jan. 27, 1977

[51] Int. Cl.[3] ..... B05D 1/26; B05D 1/34; B05C 5/02

[52] U.S. Cl. ..... 427/295; 118/50; 118/411; 427/402; 427/434.2

[58] Field of Search ..... 118/411, 412, 50; 427/434 A, 434 R, 402, 434.2, 434.3, 295

[56] References Cited

U.S. PATENT DOCUMENTS 3,928,678 12/1975 Jackson ..... 118/411 X

*Primary Examiner*—Evan K. Lawrence
*Attorney, Agent, or Firm*—John W. Ericson

[57] ABSTRACT

Method and apparatus for coating a moving web with a multilayer liquid composition. The liquid composition is flowed by gravity down an inclined surface having slots for feeding each layer onto the inclined surface. A lip at the lowermost end of the inclined surface changes the direction of flow of the composition to a generally upward direction generally aligned with the direction of movement of the web. The angle between the upward direction of liquid flow at the end of the lip and the tangent to the web at the point of initial contact of the liquid composition and the web is between about 95 degrees and 175 degrees.

15 Claims, 3 Drawing Figures

FIG. 1
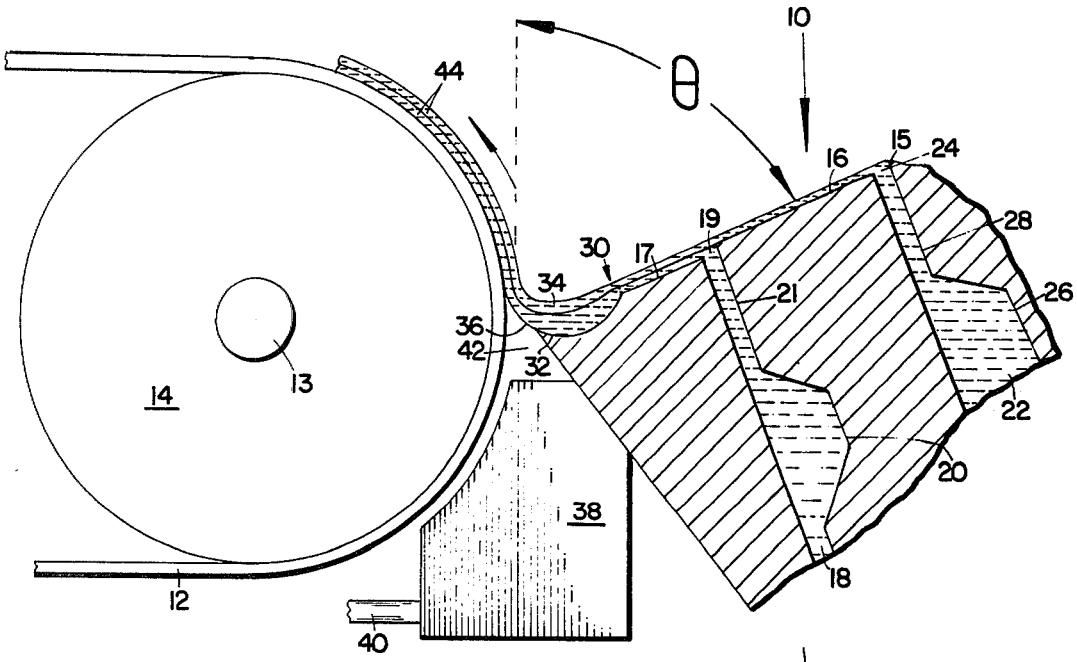
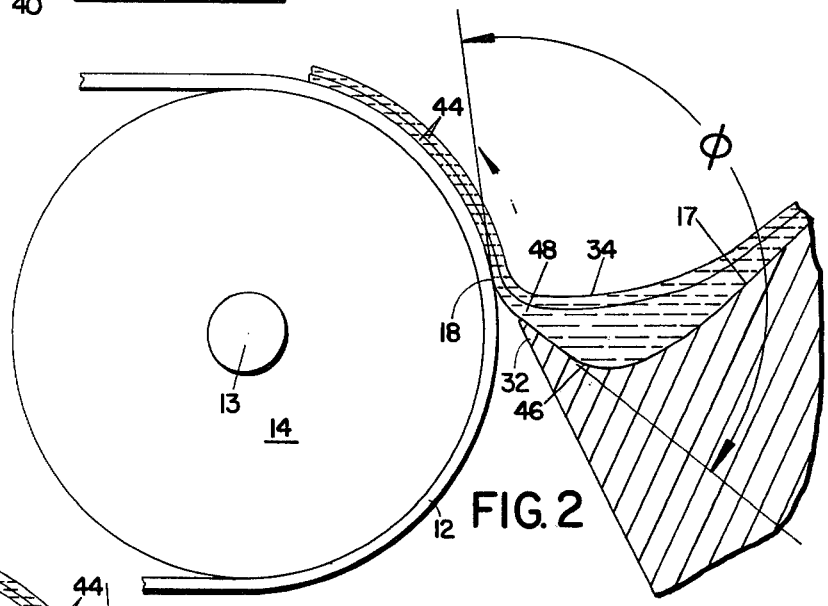
FIG. 2
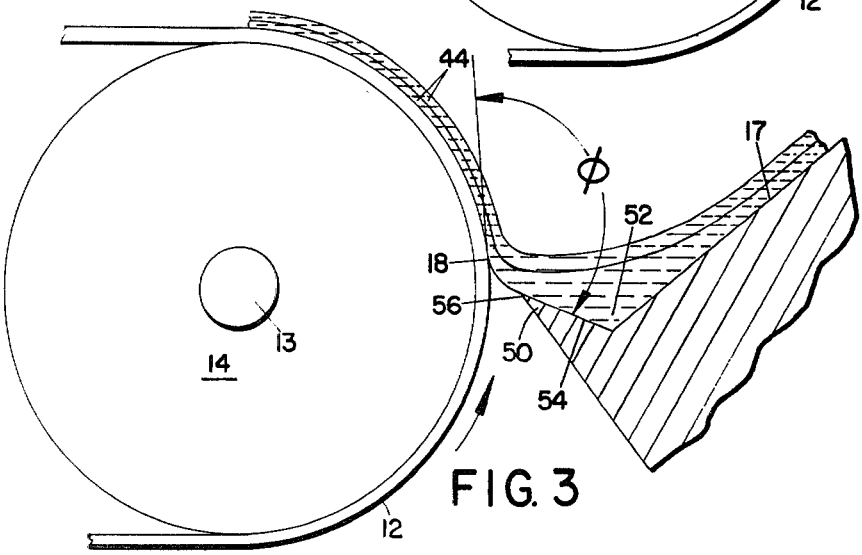
FIG. 3

METHOD AND APPARATUS FOR COATING WEBS

BACKGROUND OF THE INVENTION

This invention relates to a method and apparatus for coating a moving web with one or a plurality of coatings and more particularly to a method and apparatus for coating a moving web with one or more liquid compositions which are subsequently dried, set or gelled on the web.

Presently, there is available coating apparatus for applying a plurality of superimposed layers to a moving web. Typical apparatus utilizes a plurality of inclined surfaces separated by exit slots through each of which is metered a coating solution onto an adjacent inclined surface. The coating solutions flow by gravity over the inclined surfaces and those metered through upstream slots flow over coating solutions metered through downstream slots and form a multilayered stream, formed of the individual coating solutions that cascade over the downstream inclined surfaces. As the coating solutions flow under gravity over the inclined surfaces, each layer becomes smooth and is of uniform thickness. At the last inclined surface or slide, the multilayered stream is stratified in a configuration which constitutes the desired multilayered coating to be contacted with the moving web. The end of the last slide is spaced apart from the moving web so that the multilayered stream exiting the last slide toward the web forms a bead or bridge between the last slide and the moving web. A pressure differential generally is effected across the bead by applying a vacuum to the bottom surface of the bead immediately adjacent the top surface of the web to stabilize the bead against excessive vibration and rupture. As the web contacts the bead, it entrains the multilayered coating, thereby becoming coated.

The coating apparatus described is especially useful, for example, to form webs coated with superimposed layers of aqueous photographic compositions including light sensitive materials, chemical sensitizers, antifoggants, developing agents and the like. These compositions are mixed with synthetic or naturally occurring colloids such as gelatin, polyvinyl compounds, or the like, which form non-flowing set layers containing the photographic compositions when the colloid is dried on the web.

Typical examples of the apparatus described above are described in U.S. Pat. Nos. 2,761,419, 3,220,877, 3,749,053, 3,928,678 and 3,928,679. In the apparatus disclosed in U.S. Pat. Nos. 2,761,419 and 3,220,877, the angle between the last slide and the tangent to the web at the point of coating contact is acute. In the apparatus disclosed in U.S. Pat. Nos. 3,928,678 and 3,928,679, the angle between the last slide and the tangent to the web at the point of coating contact may be from 45 degrees to 125 degrees. While the apparatus described in these patents permit adequate coating rates when the lowermost layer is of low viscosity of about 35 centipoise or less, the rate of applying multilayered coatings of the desired thickness on the web is undesirably limited when the lowermost layer has a relatively high viscosity of about 100 to 200 centipoise or more. In order to maintain stability of the bead between the web and the last slide and to prevent turbulence leading to intermixing of the layers, an increased vacuum on the lowermost layer of the bead must be applied when increasing coating rates. When applying the coating at an acute angle or at a right angle in the manner shown in the above-identified patents, longitudinal ribbing of multilayered coating in the bead occurs when applying a relatively low pressure differential on the bead so that the coating applied to the web is non-uniform in the lateral web direction. Thus, the operator is forced to coat the web at relatively low rates in order to avoid forming unacceptable coated webs.

In the apparatus described in U.S. Pat. No. 3,749,053, a planar web is passed through a vacuum chamber and past a slide coater positioned adjacent the chamber outlet, which coater is adapted to coat the web with a multilayer liquid composition. The angle between the plane of the moving web and the slide surface is obtuse. This apparatus is undesirable as a means for coating webs since the angle between the slide surface and the moving web is fixed so that it cannot be adjusted to provide optimum coating rates for liquids of varying viscosities.

SUMMARY OF THE INVENTION

In the method and apparatus of this invention, the lip of the last slide adjacent the web is shaped to form an obtuse angle with the tangent of the web at the point of initial contact of the liquid coating composition. The lip is shaped so that the upper surface of the lip is oriented upwardly in the direction of web movement. This is achieved by making a depression that can be formed of a smooth curved surface or a flat surface which forms an angle relative to the upstream slide surface. The lip changes the direction of inertial force of the cascading liquid so that it is directed in generally the same direction as the moving web at the point of contact with the web rather than being directed normal to or opposite to the direction of the moving web. This results in far less turbulence among the strata of the multilayer liquid composition being coated on the web at a given coating rate as compared with the method and apparatus of the prior art. Furthermore, this invention greatly reduces the ribbing effect at a given coating rate encountered in the prior art. In addition, since the inertia of the liquid at the point of contact is in the same direction as the web movement, a greater pressure differential between the top and bottom surfaces of the bead between the web and lip can be applied without causing the top surface of the liquid in the bead to change its direction sharply. For these reasons the method and apparatus of this invention permit applying a single or multilayer liquid coating to a web to produce satisfactory products at a significantly higher coating rate than can be obtained with the method and apparatus of the prior art. In addition, the surface of the lip permits the multilayer liquid to form a pool which is deep relative to the height of liquid in the upstream slides so that particles in the solution are swept through the bead without being caught on the lip where they can cause streaks.

BRIEF DESCRIPTION OF THE DRAWINGS

FIG. 1 is a side view in partial cross-section, of the multiple slide apparatus of this invention.

FIG. 2 is a close-up view, in partial cross-section, of the last slide and lip having a smooth curved surface of this invention.

FIG. 3 is a close-up view, in partial cross-section, of the last slide and lip having a planar surface of this invention.

DESCRIPTION OF THE SPECIFIC EMBODIMENTS

Referring to FIG. 1, the coating apparatus 10 is positioned adjacent a web 12 supported by a driven roller 14. The coating apparatus includes a plurality of slides 15, 16 and 17. The coating apparatus 10 is shown in operation for applying a two-layered liquid coating for illustrative purposes. It is to be understood that the liquid can comprise one or more than two layers if desired. Liquid composition 18 is extruded through slot 19 between slides 16 and 17 by a conventional metering pump (not shown) which pumps liquid 18 into reservoir 20, through channel 21 and through slot 19. Liquid composition 22 also is extruded through a slot 24 between slides 15 and 16 by a conventional metering pump (not shown) which pumps liquid 22 into reservoir 26, through channel 28 and through slot 24. The width of the slots 19 and 24 extend a distance which is generally coextensive with the width of the web 12. The web 12 is formed of any suitable flexible material such as paper, plastic or metal and may be coated with other materials prior to being coated in accordance with this invention. The liquid compositions 18 and 22 exit the respective slots 19 and 24 onto slides 16 and 17. Liquid composition 18 flows by gravity down slide 17 and spreads to form a smooth layer of generally uniform height. Liquid composition 22 flows by gravity down slide 16 and similarly forms a smooth layer thereon. At slot 19, liquid composition 22 overflows liquid composition 18 to form a two-layered liquid 30 wherein little or no intermixing of the layers occurs. The two-layered liquid 30 flows into lip 32 of slide 17 to form a two-layered pool 34.

The lip 32 functions to change the direction of the inertial force of the two-layered liquid 30 so that it flows from the lip in a direction generally upward with the moving web 12. A two-layered liquid bead 36 is formed between the edge of the lip 32 and the web 12 and the bead is stabilized by a vacuum generated by vacuum chamber 38 which is connected to a vacuum pump (not shown) by conduit 40 to exhaust air from chamber 42.

As the web 12 advances with the roller 14 past bead 36, it picks up the two-layered liquid to form a coated layer 44 of the two liquids on web 12. The layer 44 is dried in any conventional manner downstream of the roller 14.

The preferred lip construction is shown in FIG. 2. The lip 32 includes a curved depression 46 extending from the planar surface of slide 17 to the lip edge 48. The curved depression extends across the lateral dimension of slide 17 to be coextensive with the width of the coating 44 on web 12. The depression 46 is a smooth curve and has a size which permits sufficient time for the multilayered liquid, to level with respect to the horizontal thereby preventing an abrupt change in the direction of the liquid during the coating operation. The included angle $\phi$ between the upward direction of fluid flow at the end of the lip and the tangent to the moving web at the point of initial contact of the liquid 18 is at least about 95° and usually is between about 120° and 150°. By utilizing an included angle of at least about 95°, the change in direction of the multilayered liquid when applied to the moving web is gradual and thereby permits high coating rate with a high viscosity lowermost liquid layer without encountering undesirable ribbing. In use, the lip edge 48 can be positioned between about 45° below the horizontal diameter of roller 14 and 45° above the horizontal diameter of roller 14 in order to obtain optimum uniform coatings.

Often it is necessary to change the angle $\phi$, (FIG. 1) which the slide surface 17 makes with respect to the vertical, while coating, due to changes in flow or coating composition. This can be readily accomplished by rotating the planar surface 17, about point 13, the center of roller 14 without changing the included angle $\phi$.

The gap between the web 12 and lip edge 48 generally is between about 0.005 and 0.06 inches. With the lip configuration shown in FIG. 2, the upper coating rate will depend upon the viscosity of the lowermost liquid layer 18 which usually is between about 35 and 200 centipoise which permits utilizing a vacuum between about 1 inches of water and 10 inches of water without causing turbulence between the liquid coating layers and without causing undesirable ribbing.

Referring to FIG. 3, the lip 50 includes a depression 52 extending across the width of slide 17 to be coextensive with the width of coating 44 on web 12. The angle $\phi$ between the tangent to the web at the point of contact of the coating 18 and the planar surface 54 is between about 95° and 175°, preferably between about 120° and 150°. The lip edge 56 is positioned as is the lip edge 48 in FIG. 2.

It is to be understood that this invention is not limited to the embodiments specifically described but includes modifications which will be evident to the person skilled in the art.

What is claimed is:

1. The method for coating a web moving in a generally upwardly direction along a predetermined path segment with a liquid composition comprising at least two superposed separate and distinct layers which comprises:

a. feeding at least two liquid streams through vertically spaced slots onto downwardly inclined slide surfaces so that the liquid streams flow by gravity down the slide surfaces to form superposed distinct layers on the lowermost slide surface;

b. flowing said liquid layers into a pool on said lowermost surface for a time sufficient to level said layers relative to the horizontal;

c. changing the direction of flow of said liquid layers at the lowermost end of said lowermost inclined surface to a generally upward direction and in generally the same direction as the movement of said web as said layers move to a location adjacent said path segment and spaced therefrom by a gap; and d. flowing said liquid layers across said gap in a generally upward direction to contact and coat said moving web.

2. The method of claim 1 wherein the angle between the upward direction of flow of said liquid composition at said location and the tangent to the web at the point of initial contact with said liquid composition is between about 95 degrees and 175 degrees.

3. The method of claim 1 wherein said liquid composition is caused to change direction at the lowermost end of said inclined surface by being flowed over a smooth curved surface.

4. The method of claim 2 wherein said liquid composition is caused to change direction at the lowermost end of said inclined surface by being flowed over a smooth curved surface.

5. The method of claim 1 wherein said liquid composition is caused to change direction at the lowermost end of said inclined surface by being flowed over a planar surface that intersects with the lowermost end of said inclined surface.

6. The method of claim 2 wherein said liquid composition is caused to change direction at the lowermost end of said inclined surface by being flowed over a planar surface that intersects with the lowermost end of said inclined surface.

7. The method of claim 1 including the step of establishing a pressure differential across the liquid composition in said gap wherein the lowermost layer is exposed to a lower pressure.

8. The method of claim 2 including the step of establishing a pressure differential across the liquid composition in said gap wherein the lowermost layer is exposed to a lower pressure.

9. Apparatus for coating a web moving over a path segment in a generally upwardly direction with a liquid composition comprising at least two liquid layers wherein layers within said composition are separate and distinct comprising in combination:

a. means comprising vertically spaced discharge slots for flowing said liquid compositions down an inclined surface, b. said inclined surface having a generally upwardly directed lip at its lowermost end, said lip forming a pool with upstream portions of said inclined surface of sufficient size to cause said liquid composition to level relative to the horizontal, said lip being adapted to alter the direction of flow of said liquid composition in a generally upward direction and in generally the same direction as the direction of web movement; and c. the end of said lip being positioned away from said web to form a gap across which said liquid composition flows to coat said moving web.

10. The apparatus of claim 9 wherein said lip includes a smooth curved surface.

11. The apparatus of claim 9 wherein said lip includes a planar surface that interacts with the lowermost end of said inclined surface.

12. The apparatus of claim 9 wherein the angle between the direction of flow of said liquid composition at the end of said lip and the tangent to the web at the point of initial contact with said liquid composition being between about 95 degrees and 175 degrees.

13. The apparatus of claim 9 including means for establishing a pressure differential across the liquid composition in said gap wherein the lowermost layer is exposed to a lower pressure.

14. The apparatus of claim 10 including means for establishing a pressure differential across the liquid composition in said gap wherein the lowermost layer is exposed to a lower pressure.

15. The apparatus of claim 11 including means for establishing a pressure differential across the liquid composition in said gap wherein the lowermost layer is exposed to a lower pressure.

* * * * *